US011131521B2

(12) United States Patent
Jeannot

(10) Patent No.: US 11,131,521 B2
(45) Date of Patent: Sep. 28, 2021

(54) ROCKET LAUNCH MODULE AND ROCKET LAUNCH VEHICLE

(71) Applicant: Mac Jee Industria de Defesa LTDA., Sao Jose dos Campos-SP (BR)

(72) Inventor: Simon Pierre Jeannot, Sao Paulo (BR)

(73) Assignee: Mac Jee Industria de Defesa LTDA., Sao Jose dos Campos (BR)

( * ) Notice: Subject to any disclaimer, the term of this patent is extended or adjusted under 35 U.S.C. 154(b) by 0 days.

(21) Appl. No.: 16/638,689

(22) PCT Filed: Aug. 17, 2017

(86) PCT No.: PCT/BR2017/050235

§ 371 (c)(1),
(2) Date: Feb. 12, 2020

(87) PCT Pub. No.: WO2019/033182

PCT Pub. Date: Feb. 21, 2019

(65) Prior Publication Data

US 2021/0190452 A1 Jun. 24, 2021

(51) Int. Cl.

| | |
|---|---|
| ***F41A 23/42*** | (2006.01) |
| ***F41A 23/40*** | (2006.01) |
| ***F41A 27/22*** | (2006.01) |
| ***F41A 27/24*** | (2006.01) |
| ***F41A 27/28*** | (2006.01) |
| ***F41F 3/042*** | (2006.01) |

(52) U.S. Cl.

CPC ..... *F41A 23/42* (2013.01); *F41A 23/40* (2013.01); *F41A 27/22* (2013.01); *F41A 27/24* (2013.01); *F41A 27/28* (2013.01); *F41F 3/042* (2013.01)

(58) Field of Classification Search

CPC ..... F41A 23/40; F41A 23/42; F41A 23/54; F41A 23/52; F41A 27/22; F41A 27/24; F41A 27/28; F41A 27/16

USPC .... 89/1.815, 1.8, 1.801, 1.802, 1.803–1.807, 89/1.816, 38, 39

See application file for complete search history.

(56) References Cited

U.S. PATENT DOCUMENTS

| | | | | | |
|---|---|---|---|---|---|
| RE1,536 | E | * | 9/1863 | Eads | 89/38 |
| 3,106,132 | A | * | 10/1963 | Biermann | F41F 3/04 89/1.815 |
| 3,316,808 | A | * | 5/1967 | Mais | F41A 23/42 89/1.804 |
| 3,316,809 | A | * | 5/1967 | Riedel | F41A 23/20 89/1.815 |
| 3,786,715 | A | * | 1/1974 | Even | F41A 9/14 89/1.805 |

(Continued)

FOREIGN PATENT DOCUMENTS

| | | |
|---|---|---|
| CN | 202098334 U | 1/2012 |
| CN | 202101606 U | 1/2012 |

(Continued)

*Primary Examiner* — John Cooper
(74) *Attorney, Agent, or Firm* — Proskauer Rose LLP

(57) ABSTRACT

The present invention relates to a rocket launching module comprising a base frame (1) comprising at least one rail (2*a*); a sliding table (3) configured to slide substantially vertically on said rail (2*a*) when driven by at least one electric linear actuator (11), and a targeting device (4) comprising a turntable (5) on which a pivotable body (6) is mounted, supporting a rocket support portion (7). The sliding table (3) comprises a platform (8) configured to receive the turntable (5) of the targeting device (4).

20 Claims, 11 Drawing Sheets

(56) References Cited

U.S. PATENT DOCUMENTS

| | | | | | |
|---|---|---|---|---|---|
| 4,141,277 | A * | 2/1979 | Bouillon | F41A 23/20 | 89/1.802 |
| 4,282,794 | A * | 8/1981 | Miller | B60G 17/052 | 182/148 |
| 4,574,685 | A * | 3/1986 | Sanborn | F41A 23/34 | 89/36.13 |
| 4,667,565 | A * | 5/1987 | Anderson | F41A 23/20 | 89/36.08 |
| 6,009,791 | A * | 1/2000 | Medlin | F41A 23/20 | 89/136 |
| 7,013,790 | B2 * | 3/2006 | Helms | F41A 23/20 | 89/1.804 |
| 7,086,318 | B1 * | 8/2006 | Darnall | F41A 23/42 | 89/1.815 |
| 8,146,479 | B2 * | 4/2012 | Cazalieres | A62C 31/005 | 89/36.13 |
| 8,393,258 | B2 * | 3/2013 | Cazalieres | F41A 23/20 | 89/41.01 |
| 8,468,924 | B2 * | 6/2013 | Skurdal | F41F 3/073 | 89/1.819 |
| 9,261,329 | B2 * | 2/2016 | Kempas | F41F 3/042 | |
| 2003/0089220 | A1 * | 5/2003 | Boudreau | F41A 23/42 | 89/1.815 |
| 2004/0069136 | A1 * | 4/2004 | Smith | F41F 3/0406 | 89/1.815 |
| 2012/0036987 | A1 * | 2/2012 | Guruprasad | F41A 23/34 | 89/1.806 |
| 2020/0130836 | A1 * | 4/2020 | Kurikesu | B64D 9/00 | |

FOREIGN PATENT DOCUMENTS

| | | | |
|---|---|---|---|
| CN | 103528439 | A | 1/2014 |
| CN | 204759886 | U | 11/2015 |
| CN | 106828962 | A | 6/2017 |
| EP | 2381204 | A2 | 10/2011 |
| JP | 2013185749 | A | 9/2013 |
| KR | 20100056819 | A | 5/2010 |
| KR | 20100064677 | A | 6/2010 |

* cited by examiner

ROCKET LAUNCH MODULE AND ROCKET LAUNCH VEHICLE

FIELD OF INVENTION

The present invention relates to a rocket launching module that can be independently operated or that can be installed on the body of a vehicle.

BACKGROUND OF THE INVENTION

Various artillery equipment for the transport and launching of artillery are known in the art. For land use, the most well-known solutions involve vehicles such as tanks and 4×4 wheeled cars and combat trucks.

A common type of rocket launching vehicle comprises a vehicle whose body has a flat support surface that receives the launching equipment. The apparatus comprises a box-like structure with rocket receiving cylinders. The housing is pivotable between a position where the cylinders have their longitudinal geometric axis parallel to the plane of the support surface and a position where the lower surface of the housing structure is at an acute or right angle to the support surface, with the pivotable axle being generally arranged near the rear end of the vehicle.

Thus, according to the type and weight of weaponry employed, the box-type structure and articulation device should be sized to support the weight of the pivoting structure and rockets to be launched. Typically, the higher the weight of the rockets, the smaller the amount that can be packed at a time in the box structure. For heavy weaponry, such as missiles, the box-like structure is generally smaller in capacity, accommodating from two to four missiles at a time.

The weight of the weaponry influences both the capacity of the box-like structure and the construction of the pivotable articulation system. Since the weapon handling needs to be done with a large margin of safety, the pivotable articulation system must be both robust and secure.

Another disadvantage associated with known launching equipment is the need to have a vehicle completely dedicated to launching as the vehicle must be modified to incorporate the pivotable articulation system and to form the flat support surface.

In addition to the problems noted above, known launching equipment also has a limitation related to weapon aiming, as the box structure has limited movement to the pivot joint.

Some solutions are known in the art to provide greater flexibility for launching equipment.

Document EP 1739382 shows a projectile launcher comprising a vehicle with a pivotable launching platform with a plurality of launching structures arranged side by side.

Document EP 2 754 989 shows a rocket launch container that is received by a device having a lateral steering portion and a vertical steering portion.

Document JP 2003/056997 describes a missile launcher that allows for greater freedom of launch angle adjustment. The adjustment system comprises a pneumatic system with pivot arms.

Document US 2010/0282150 discloses a folding ramp specially adapted for use on ships. The ramp has a folding structure where the missile supports are installed. The folding structure comprises articulated arms.

Document U.S. Pat. No. 3,316,809 shows a retractable missile launcher for an armored vehicle. A shell containing the missiles is mounted on a shielded ring with a track displacement system and a rack and gear system is used for shrinkage of the shell.

Document U.S. Pat. No. 7,013,790 describes a weaponry drive system comprising a support cage, a movable platform carrying a weapon and a retractable roof covering the weapon.

Document EP 0 612 969 describes an all-terrain vehicle with a pivotable structure with a rig platform, where the structure is pivotable between a transport position and an operating position.

These known solutions, however, either fail to provide the strength required to support a missile or rocket-type artillery assembly or comprise excessively complex structures, requiring the use of systems with a plurality of mechanical, hydraulic-actuated or pneumatic arms.

Thus, a need in the art for a solution that allows launching rockets in a stable and robust but simple and that allows the use of the module independent form or installed in a vehicle remains.

OBJECTIVES OF THE INVENTION

It is an object of the present invention to provide a stable, robust and versatile rocket launching module.

It is another object of the present invention to provide a rocket launching module that can be operated independently or can be installed on a vehicle body.

It is a further object of the present invention to provide a rocket launching module with a protected configuration when arranged in a retracted configuration in the body of a vehicle.

It is yet another object of the present invention to provide a rocket launching module whose retraction and steering movement is driven by electric actuators.

BRIEF DESCRIPTION OF THE INVENTION

The present invention achieves the above objectives by means of a rocket launching module comprising a base frame comprising at least one rail; a sliding table configured to slide substantially vertically on said rail when driven by at least one electric linear actuator; and a targeting device comprising a turntable on which a pivotable body supporting a rocket support portion is mounted. The sliding table comprises a platform configured to receive the turntable of the targeting device.

Preferably, the base frame comprises a four-column rectangular shaped frame, each of the four columns defining a rail; the sliding table comprises a support structure supporting the substantially flat platform; the sliding table support structure comprises a plurality of lugs configured to slide into the frame rails; and the substantially flat platform sliding table comprises an opening that receives the turntable for the targeting device.

In order to provide a steady displacement of the slide table, the module further comprises two linear actuators arranged at opposite ends of the frame, wherein the actuators are powered by electric motor and connected to the slide table by a transition piece.

Preferentially, the body of the pivotable targeting device is designed so that the position of its articulation axis coincides with the center of mass of the support portion receiving a set of rockets.

The pivoting movement of the turntable and the pivoting movement of the pivoting body are preferably driven by an electric actuator.

The module may comprise an outer cage that may be used for transportation or, when provided with feet, allows the module to operate independently.

The present invention further contemplates a rocket launch vehicle comprising a body having an upper opening that can be selectively opened or closed and the launching module of the present invention, so that when the upper opening of the body is closed, the sliding table is retracted from the frame; and when the upper body opening is open; the sliding table is slid vertically on the frame rails to an extended position in which the targeting device is exposed outside the vehicle body.

BRIEF DESCRIPTION OF DRAWINGS

The present invention will be described in more detail herein below with reference to the accompanying drawings, wherein.

DETAILED DESCRIPTION OF THE INVENTION

The present invention will be described hereinafter based on two embodiments of the invention shown in FIGS. 1 to 19.

Figure 1:
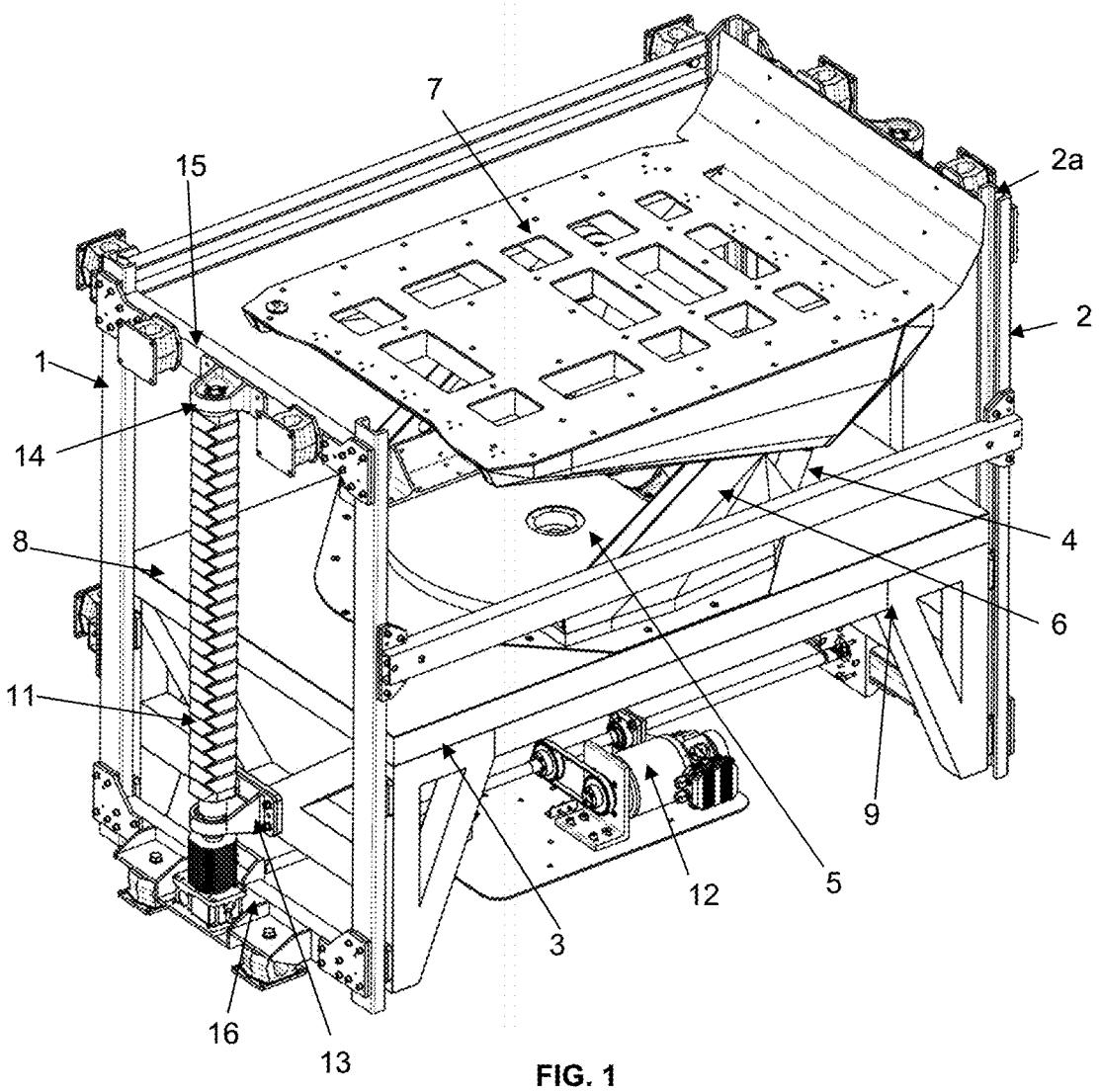
FIG. 1 is a front perspective view of a launching module in accordance with an embodiment of the present invention, the module being illustrated in a retracted configuration.
Figure 2:
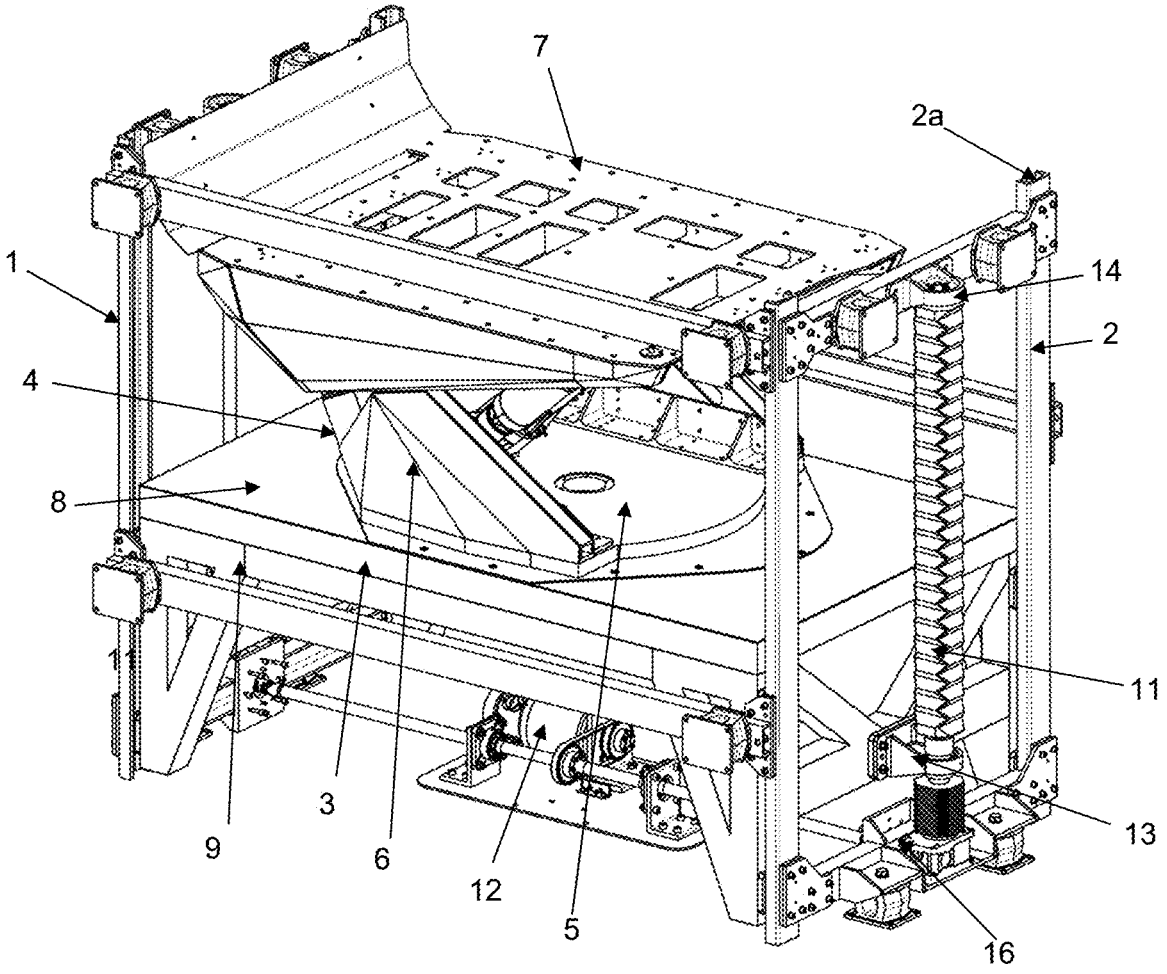
FIG. 2 is a perspective view of the rear of a launching module according to one embodiment of the present invention, the illustrated configuration module being the retracted one.

FIGS. 1 and 2 show a front perspective view and a rear perspective view of the launching module according to the preferred embodiment of the present invention.

The launching module comprises a base frame 1 and a table 3 configured to slide substantially vertically on rails of the base frame 1.

The base frame 1 preferably comprises a rectangular frame with four columns 2 arranged at the corners of the rectangle shape. Part of the inner surface of each column—that is, part of the surface of each column facing into the frame—forms a rail 2*a*.

The sliding table 3 is configured to receive a targeting device 4. Thus, in the preferred embodiment of the invention shown, the sliding table 3 comprises an opening for receiving the turntable of the targeting device 4.

Preferably, the sliding table 3 comprises a substantially flat platform 8 (with the opening) and a support structure 9.

The support structure 9 comprises shoulders configured to engage the rails 2*a* of the base frame. Preferably, the base structure comprises eight shoulders, two spaced aligned shoulders being arranged to fit each rail 2*a*.

With this configuration in frame 1 and sliding table 3, the flat platform supporting the targeting device 4 can be safely and stably moved vertically, as the platform is slidably supported on the four columns 2*a* of the base frame 1.

A linear actuator 11 powered by electric motor 12 preferably achieves the substantially vertical displacement of the sliding table 3. In the module shown in FIGS. 1 and 2 and 6 to 9, two linear actuators 11 are provided powered by a single electric motor 12.

As shown in the figures, preferably the linear actuators are arranged at opposite ends of the frame 1 so that the vertical movement of the sliding table 3 is carried out in a stable manner. The connection between each actuator 11 and the sliding table is made by a respective transition piece 13 connected to the table.

The upper part of each actuator 11 is secured to frame 1 by a fastener 14 connected to an upper crossbar 15 of frame 1. The lower part of each actuator 11 is secured to the frame by a lower mounting fixture 16.

Figure 8:
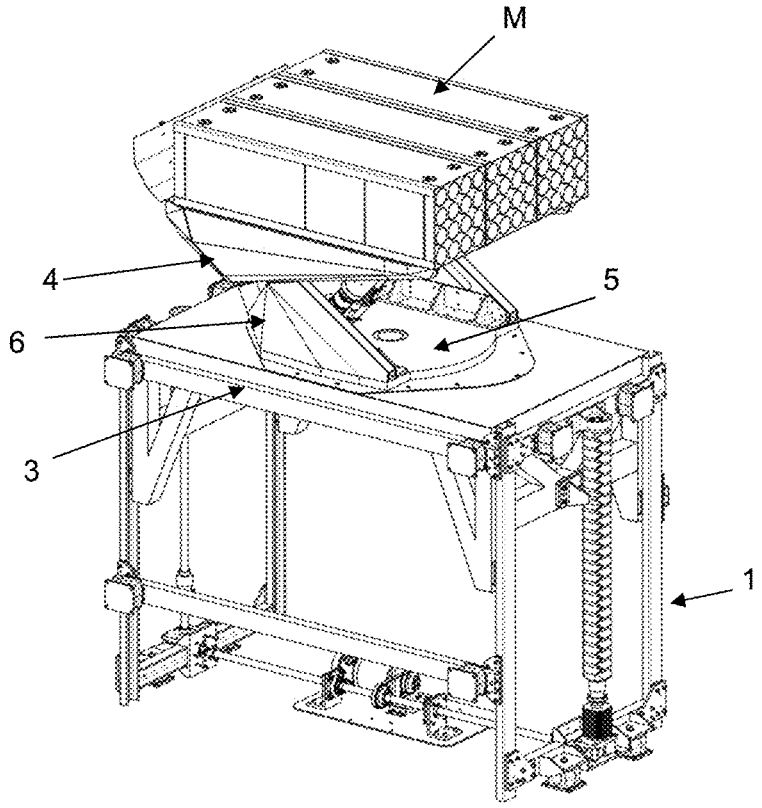
FIG. 8 is a perspective view of a launching module according to one embodiment of the present invention, the configuration of the module being shown in an expanded configuration with modular rocket receiving compartments.
Figure 9:
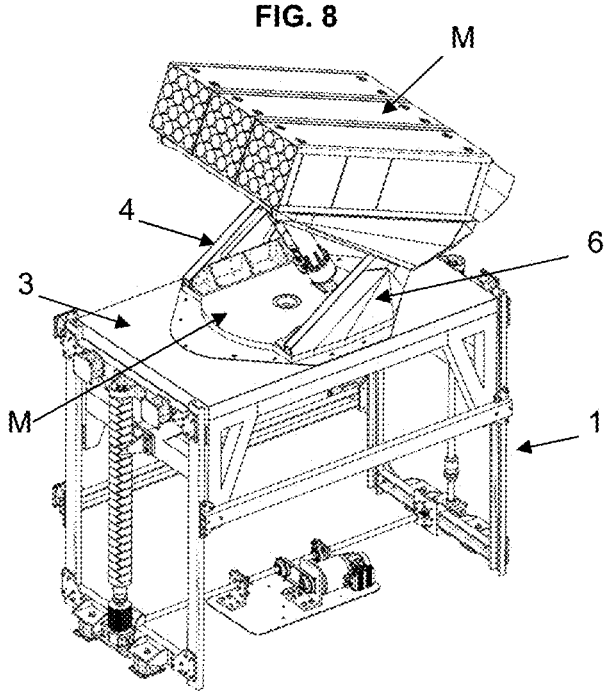
FIG. 9 is a second perspective view of a launching module according to one embodiment of the present invention, the configuration of the module being shown in an expanded configuration with modular rocket receiving compartments.
Figure 10:
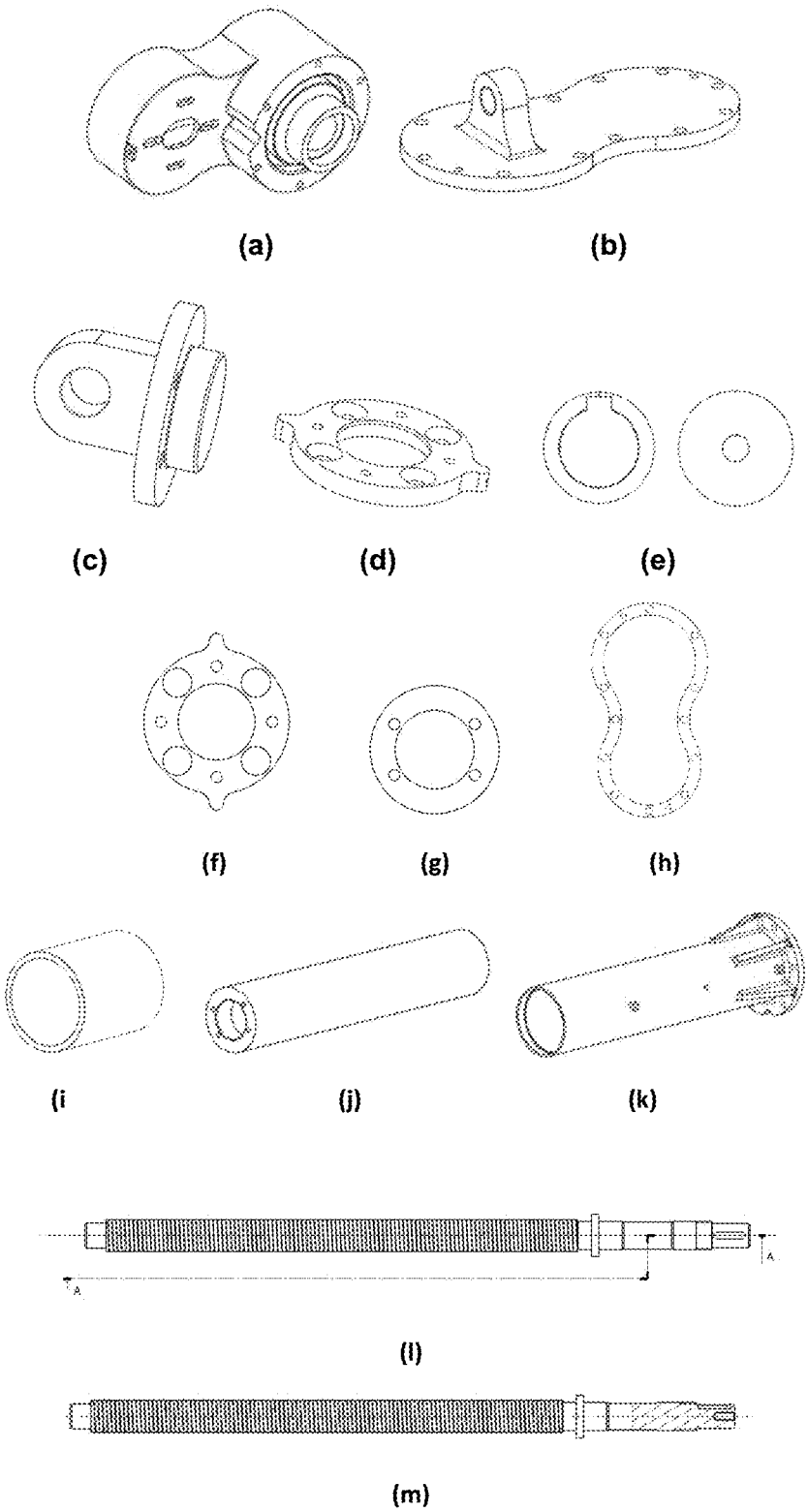
FIG. 10 is a schematic view showing the main components of the linear actuator of the launching module according to one embodiment of the present invention.

As best seen in FIGS. 8 and 9, the targeting device 4 preferably comprises a turntable 5 on which a pivotable body 6 supporting a rocket support portion 7 is mounted.

The pivotable body 6 is preferably designed such that the position of the pivot axis coincides with the center of mass/gravity of the support portion 7 receiving the modular rocket compartment.

Preferably, the pivoting movement of the turntable 5 and the pivoting movement of the pivoting body 6 are driven by an electric actuator which can, for example, be connected to the underside of the flat platform 8 of the sliding table 3.

The support portion 7 preferably comprises a substantially flat top portion on which the modular rocket compartment is supported and secured.

Figure 3:
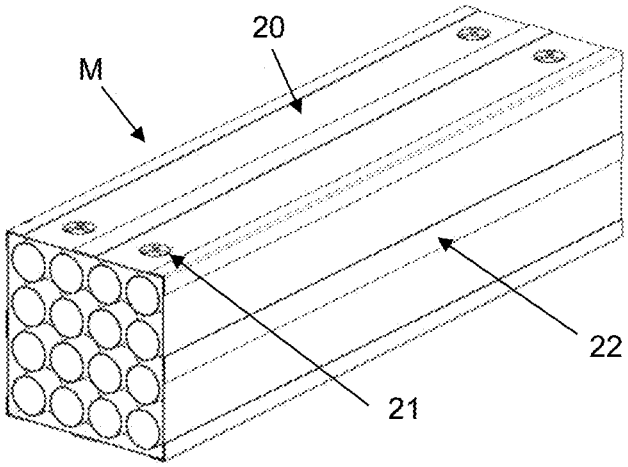
FIG. 3 is a perspective view of a modular launching module housing in accordance with an embodiment of the present invention.
Figure 4:
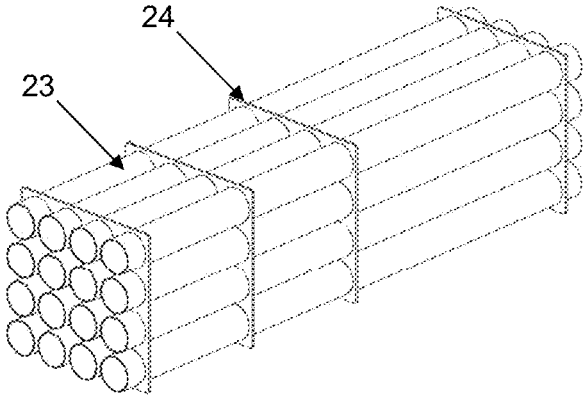
FIG. 4 is a perspective view of the interior of a modular launching module housing in accordance with an embodiment of the present invention.
Figure 5:
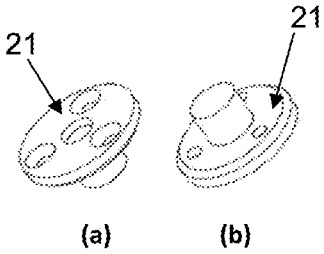
FIG. 5 is a top perspective view and bottom view of a modular bay launching module according to an embodiment of the present invention.

FIGS. 3 to 5 illustrate the modular rocket compartment M that is secured to the support portion 7 of the targeting device 4.

As can be seen from these figures, modular housing M comprises an outer wrap 20 where positioners 21 are arranged. FIG. 5 illustrates top perspective views (a) and bottom perspective view (b) of the positioner.

The outer wrap may include fairings 22 in the form of longitudinal shoulders.

In the preferred embodiment of the present invention, the outer wrap receives eight positioners, four in the upper wall and four in the lower wall.

The inner portion, shown in FIG. 4 where the housing is shown without wrap 20, is formed by a plurality of tubes 23 with frames 24 acting as supports and spacers. The tubes act as rocket receivers.

In the embodiment shown in the figures, each modular compartment M has sixteen rocket receiving tubes.

With this construction, modular compartments can be easily transported and stored. In addition, securing and replacing the M compartments in the launching module is easy, fast and secure.

Figure 6:
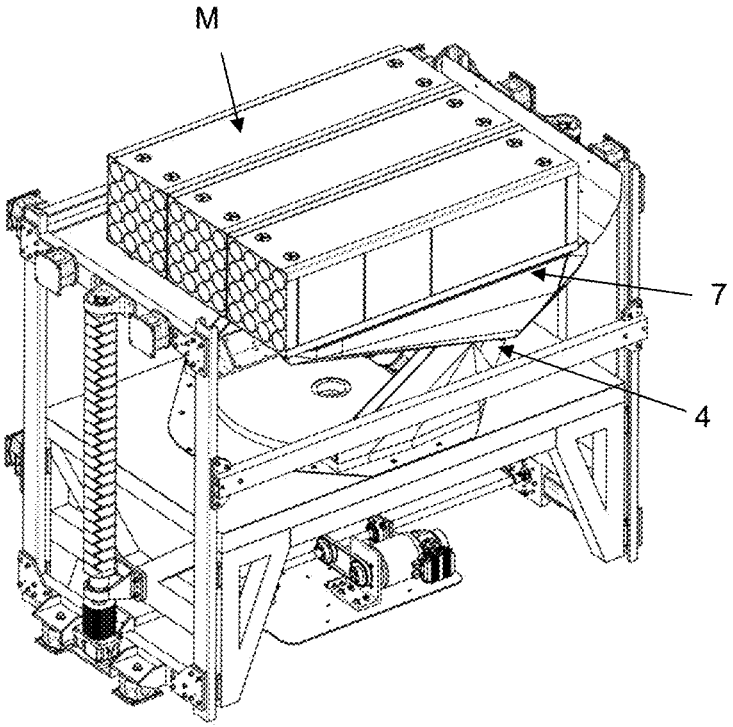
FIG. 6 is a perspective view of the front of a launching module according to one embodiment of the present invention, the configuration of the module being shown in a retracted configuration with modular compartments for receiving rockets.
Figure 7:
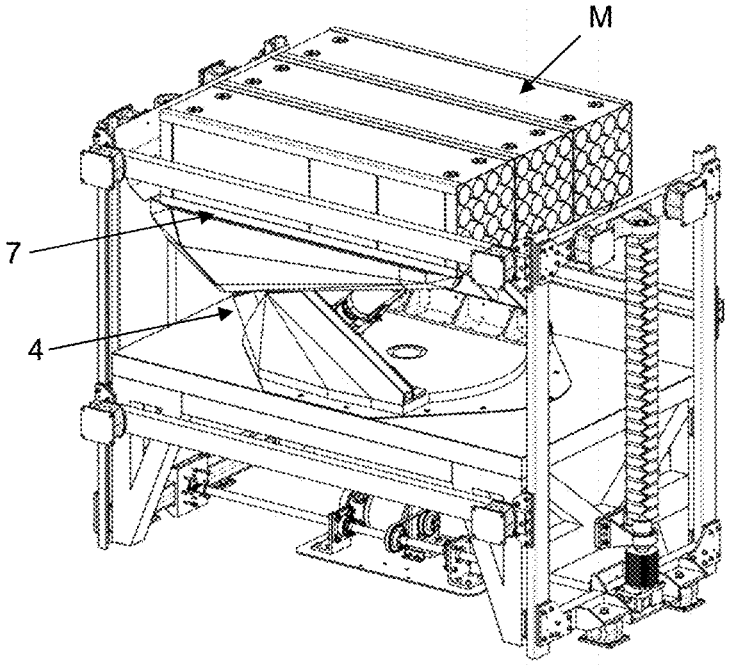
FIG. 7 is a perspective view of the rear of a launching module according to one embodiment of the present invention, the configuration of the module being shown in a retracted configuration with modular rocket receiving compartments.

As shown in FIGS. 6 and 7, the support portion 7 of the launching module targeting device 4 may receive more than one modular rocket compartment (in the figure, the module receives three modular compartments).

FIGS. 8 and 9 show the launching module in extended configuration, i.e. after the sliding table 3 slides up onto the rails 2*a* in the frame columns 2.

As can be seen from these figures, with this configuration the modular compartments M can be directed by pivoting the turntable 5 and pivoting the pivoting body 6. Since the positioning of the pivoting body axis 6 coincides with the center of gravity Based on the support portion 7 with the modular compartments M, electric actuation of the targeting device 4 is possible, which reduces the weight of the assembly and eliminates the use of hydraulic or pneumatic actuation systems.

FIG. 9 shows a preferred embodiment of linear actuator 11 according to the present invention. In the preferred embodiment, the linear actuator comprises the following elements: (a) body; (b) coverage; (c) male connector; (d) flange; (e) spacers; (f) flange-body joint; (g) cylinder rod-connector joint; (h) body-joint gasket; (i) bushing; (j) cylinder rod; (k) fixed pipe and (l) screw with planetary rollers, being seen from the AA view shown in (m).

FIGS. 11 to 17 show a second embodiment of the launching module of the present invention. In this embodiment, the launching module receives a set of rocket or F-rocket receiving tubes.

Figure 11:
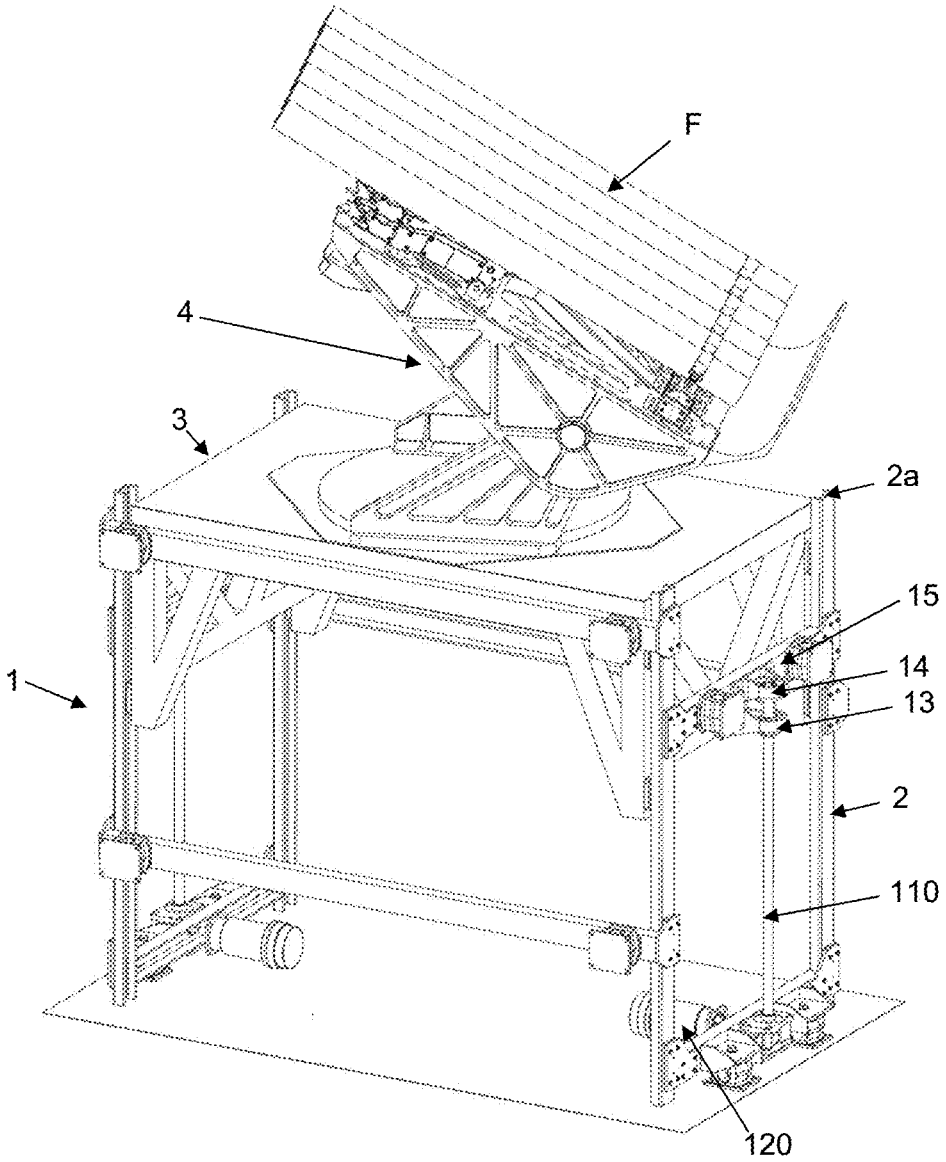
FIG. 11 is a perspective view of a launching module according to a second embodiment of the present invention, the module being shown in an expanded configuration.
Figure 12:
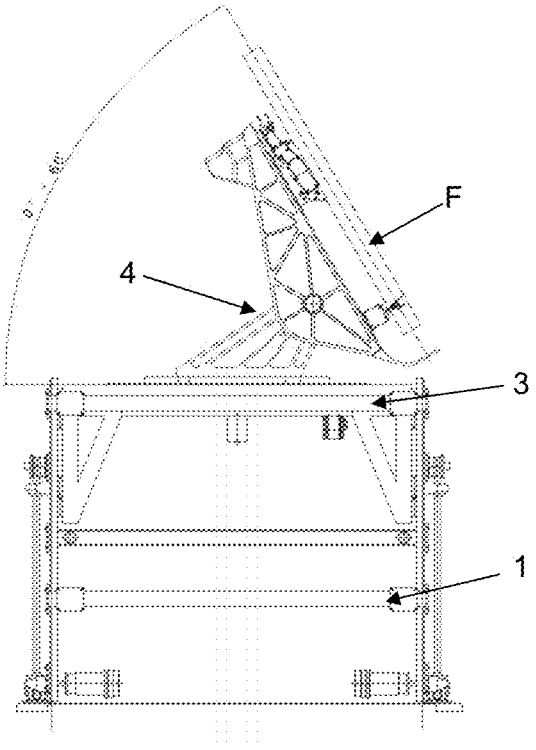
FIG. 12 is a side view of the launching module according to the second embodiment of the present invention, the module being shown in expanded configuration with the release portion of the hinge.
Figure 13:
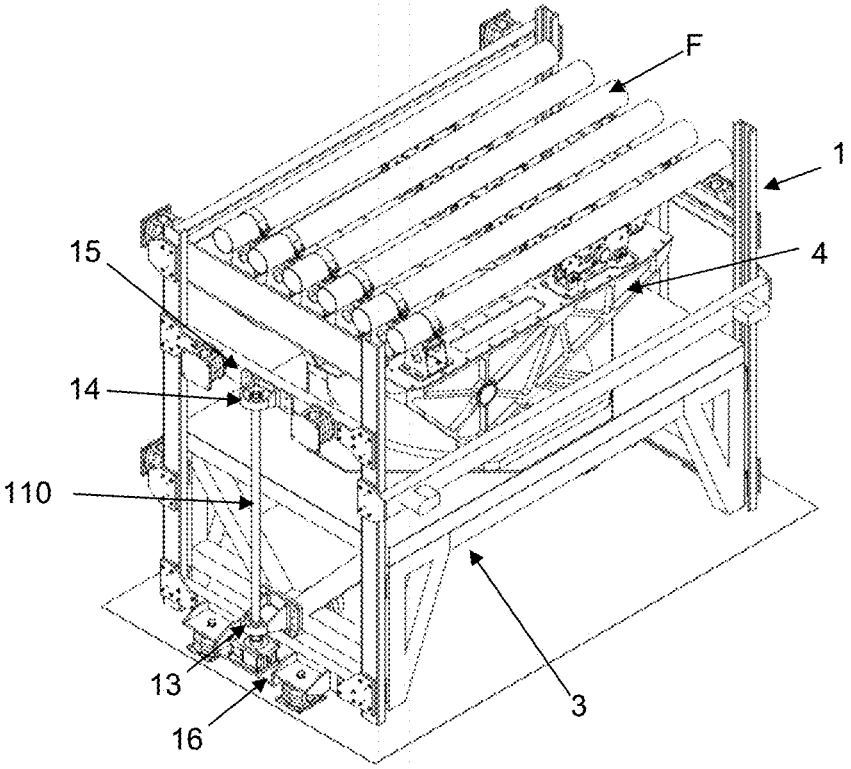
FIG. 13 is a perspective view of a launching module according to the second embodiment of the present invention, the module being shown in the retracted configuration.

FIGS. 11 and 12 show a perspective view and a side view of the launching module according to the second embodiment of the present invention, the module being shown in the extended configuration. FIG. 13 shows a perspective view of the module according to the second embodiment of the present invention in retracted configuration.

Characteristics that are similar to the first embodiment will be represented with the same reference numerals.

Thus, the launching module comprises a base frame 1 and a table 3 configured to slide substantially vertically on rails of the base frame 1.

Figure 14:
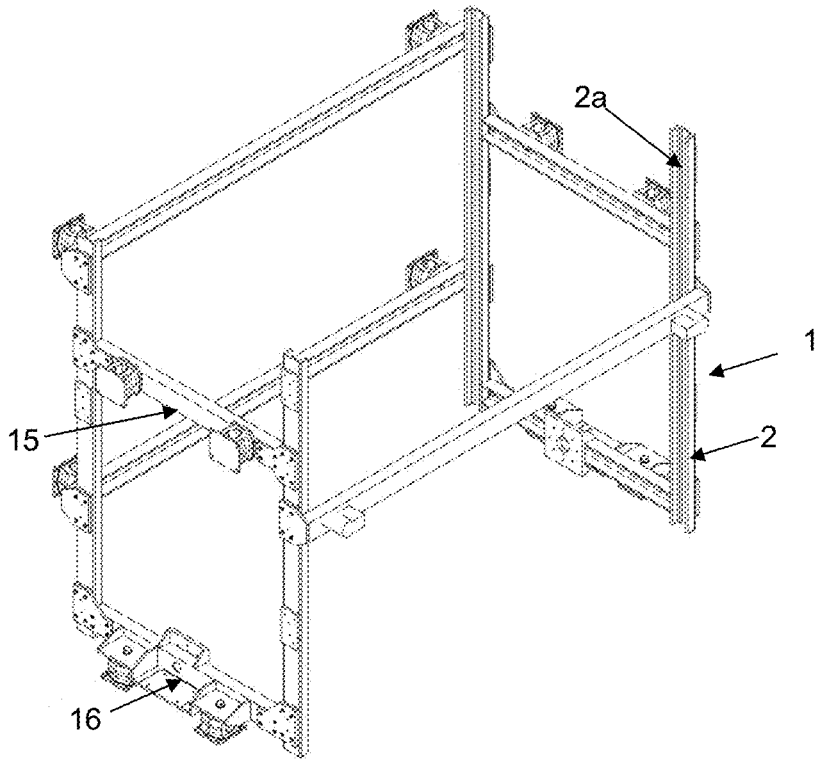
FIG. 14 is a perspective view of the frame base of the launching module in accordance with a second embodiment of the present invention.

As best illustrated in FIG. 14, the base frame 1 preferably comprises a rectangular frame with four columns 2 arranged at the corners of the rectangle shape. Part of the inner surface of each column—that is, part of the surface of each column facing into the frame—forms a rail 2*a*.

The sliding table 3 is configured to receive a targeting device 4.

Figure 16:
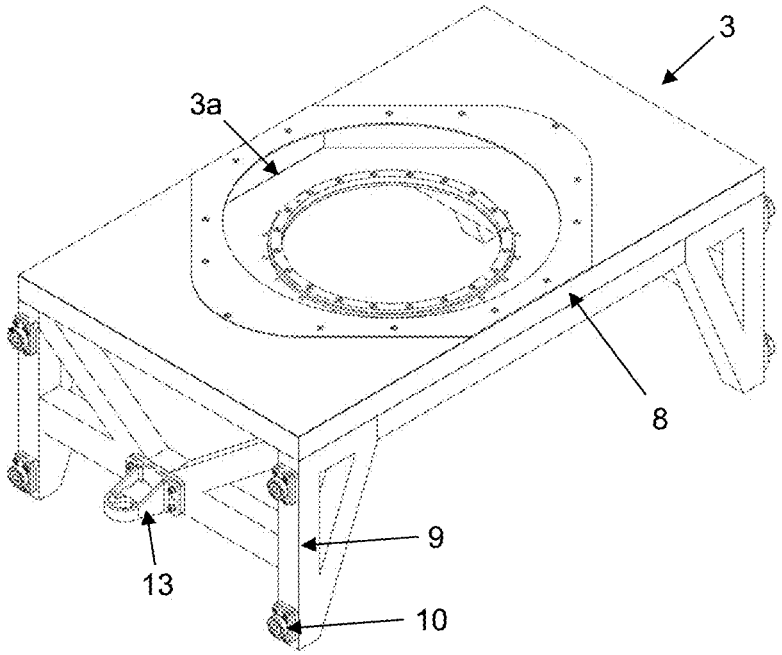
FIG. 16 is a perspective view of the launching module sliding table according to a second embodiment of the present invention.

Thus, in the embodiment shown in FIG. 16, the sliding table 3 comprises an opening 3*a* for receiving the turntable of the targeting device 4.

Still as shown in FIG. 6, the sliding table 3 comprises a substantially flat platform 8 comprising opening 3*a* and a support structure 9.

The support structure 9 comprises lugs 10 configured to engage rails 2*a* of the base frame. In this embodiment, the base frame comprises eight shoulders 10, two spaced aligned shoulders are arranged to fit each rail 2*a*.

With this configuration in frame 1 and sliding table 3, the flat platform supporting the targeting device 4 can be safely and stably moved vertically, as the platform is slidably supported on the four columns 2*a* of the base frame 1.

Figure 15:
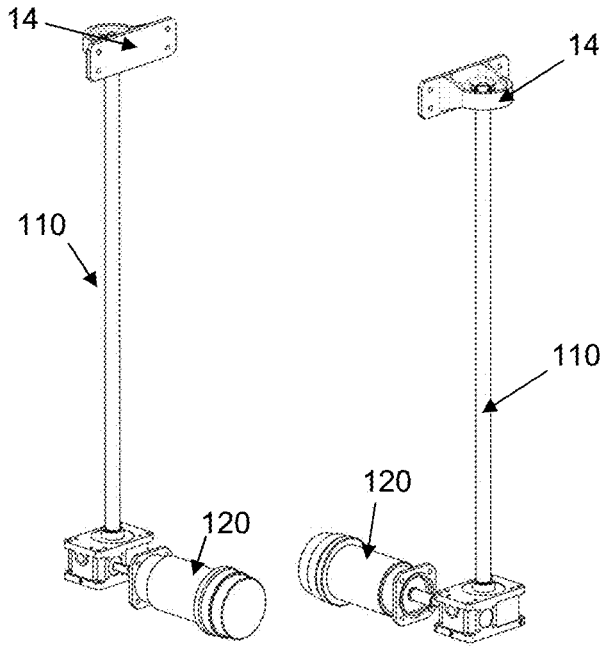
FIG. 15 is a perspective view of the release slide table module according to the second embodiment of the present invention.

The substantially vertical displacement of the sliding table 3 is achieved by a linear actuator 110, powered by electric motor 120 (electric piston schematically illustrated in the figures). Thus, as best seen in FIGS. 11, 13 and 15, the launching module preferably comprises two linear actuators 110 driven by two electric motors 120.

As shown in the figure, preferably the linear actuators are arranged at opposite ends of the frame 1, so that the vertical movement of the sliding table 3 is stable. The connection between each actuator 110 and the sliding table is made by a respective transition piece 13 connected to the table.

The upper part of each actuator 110 is secured to frame 1 by a fastener 14 connected to an upper crossbar 15 of frame 1. The lower part of each actuator 110 is secured to the frame by a lower fixture. 16

Figure 17:
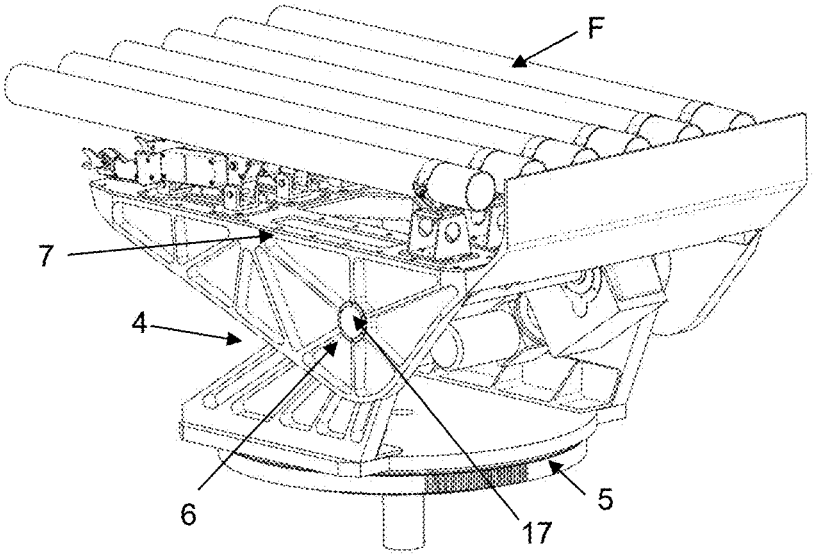
FIG. 17 is a perspective view of the launching module targeting device in accordance with a second embodiment of the present invention.

As best illustrated in FIG. 17, the targeting device 4 preferably comprises a turntable 5 on which a pivotable body 6 supporting a rocket support portion 7 is mounted.

The pivotable body 6 is preferably designed such that the position of the pivot axis 17 coincides with the center of mass/gravity of the support portion 7 receiving the rocket receiving assembly F.

Preferably, the pivoting movement of the turntable 5 and the pivoting movement of the pivoting body 6 are driven by an electric actuator which can, for example, be connected to the underside of the flat platform 8 of the sliding table 3.

The support portion 7 preferably comprises a substantially flat top portion on which the rocket receiving assembly F is supported and secured.

Figure 18:
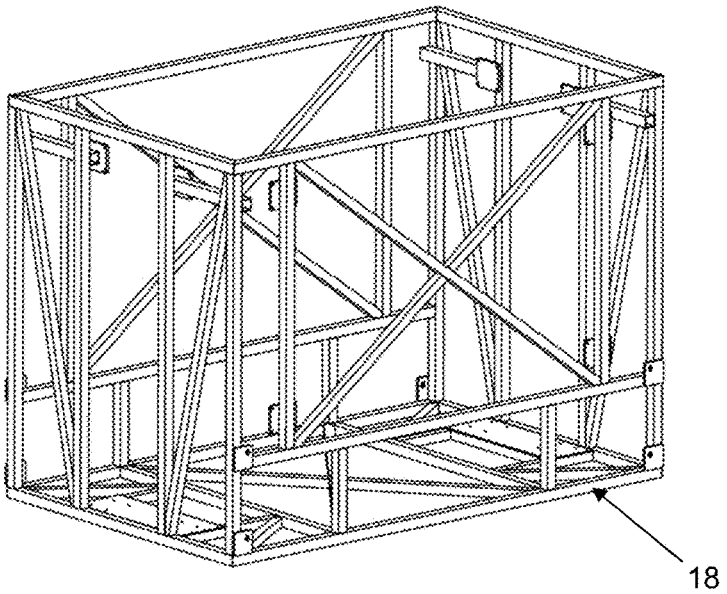
FIG. 18 is a perspective view of the outer cage of the launching module according to one embodiment of the present invention.

As shown in FIG. 18, the launching module may further comprise an outer cage 18, into which the frame/sliding table/targeting device assembly and transporting drive means may be arranged. The upper part of the outer cage 18 is preferably open to allow passage of the assembly.

Figure 19:
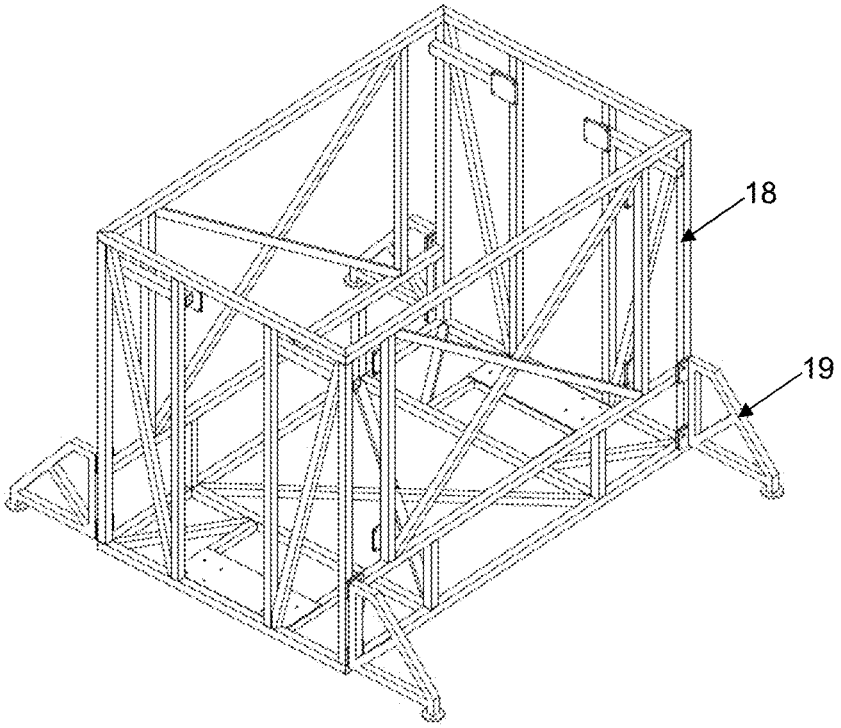
FIG. 19 is a perspective view of the outer cage of the launching module according to one embodiment of the present invention, the cage receiving support feet.

As shown in FIG. 19, support feet 19 can be attached to cage 18. Thus, cage 18 can be used as a support chassis for the module.

In this regard, it should be noted that the launching module of the present invention, with its electric actuators, may function in a completely independent way, in any vehicle. Thus, the cage 18 may serve as a chassis in case of independent operation.

Alternatively, the launching module of the present invention may be installed in a vehicle, whereby frame 1 is connected to the internal structure of the vehicle.

The launching module of the present invention provides a compact, safe and stable rocket launching solution (preferably 70 mm diameter rockets).

As shown in FIGS. 11 and 12, when the sliding table 3 is in extended configuration relative to the frame 1, the targeting device 4 can be rotated and the support surface 7 can be pivoted to adjust both the direction and angle of release.

On the other hand, as shown in FIG. 3, when the sliding table 3 is in the retracted configuration, the assembly becomes extremely compact. Thus, the module can be installed in an adapted 4×4 vehicle so that the module is completely internal to the vehicle when retracted and can be expanded through a predicted opening in the vehicle roof (when expanded, the targeting device 4 is outer to the vehicle body).

In addition, as the sliding table 3 slides over the rails 2*a* in the frame 2 columns, the flat platform 8 with the targeting device 4 can be safely and stably moved vertically by actuating the linear actuator without risk of tipping and without the need for hydraulic or pneumatic actuation systems, which ultimately reduces the risk of failures, especially considering sand or gravel operating environments.

The use of the turntable 5 and the positioning of the pivot shaft 17 of the pivoting body 6 also ensures the possibility of electrical actuation of the targeting device 4, which reduces the weight of the assembly and eliminates the use of hydraulic or pneumatic actuation systems.

Having described two example that are the preferred embodiment of the present invention, it should be understood that the scope of the present invention encompasses other possible variations of the inventive concept described herein, that is limited solely by the wording of the claims, including the possible equivalents.

The invention claimed is:

1. Module for rocket launching, comprising:

a base frame comprising at least one rail;

a sliding table configured to slide substantially vertically on the at least one rail during an actuation of at least one electric linear actuator, and a targeting device comprising a turntable configured to be mounted by a pivotable body supporting a rocket support portion;

wherein the sliding table comprises a substantially flat platform configured to receive the turntable of the targeting device.

2. Module for rocket launching according to claim 1, wherein:

the base frame comprises a rectangular shaped frame with four column, each of the four columns defining the at least one rail;

the sliding table comprises a support structure supporting the substantially flat platform;

the support frame of the sliding table comprises a plurality of lugs configured to slide into the at least one rail of the frame; and the substantially flat platform of the sliding table comprises an opening which receives the turntable of the targeting device.

3. Module for rocket launching according to claim 2, further comprising two linear actuators arranged at opposite ends of the frame.

4. Module for rocket launching according to claim 3, wherein the actuators are powered by an electric motor.

5. Module for rocket launching according to claim 4, comprising three modular rocket receiving housings, the three modular rocket receiving housings being able to be attached together to the rocket support portion.

6. Module for rocket launching according to claim 3, wherein each actuator is powered by an electric motor and is connected to the sliding table by a transition piece.

7. Module for rocket launching according to claim 1, further comprising at least one modular rocket receiving housing configured to be secured to the rocket support portion.

8. Module for rocket launching according to claim 7, wherein the pivotable body of the targeting device is designed such that the position and its pivot axis coincide with the center of mass of the support portion receiving the at least one modular rocket receiving housing.

9. Module for rocket launching according to claim 8, wherein the pivoting movement of the turntable and the pivoting movement of the pivotable body are driven by an electric actuator.

10. Module for rocket launching according to claim 1, further comprising an outer cage.

11. Module for rocket launching according to claim 10, further comprising feet for independent support of the outer cage.

12. Rocket launching vehicle comprising:

a bodywork having an upper opening which may be selectively opened or closed; and a module for rocket launching according to claim 1;

wherein:

when the upper body opening is closed, the sliding table is in a retracted position relative to the frame; and when the upper body opening is open; the sliding table is slid vertically on the at least one rail of the frame to an extended position in which the targeting device is exposed outside the vehicle body.

13. Rocket launching vehicle according to claim 12, wherein:

the base frame comprises a rectangular shaped frame with four columns, each of the four columns defining the at least one rail;

the sliding table comprises a support structure supporting the substantially flat platform;

the support frame of the sliding table comprises a plurality of lugs configured to slide into the rails of the frame; and the substantially flat platform of the sliding table comprises an opening which receives the turntable of the targeting device.

14. Rocket launching vehicle according to claim 13, further comprising two linear actuators arranged at opposite ends of the frame.

15. Rocket launching vehicle according to claim 14, wherein the actuators are powered by an electric motor.

16. Rocket launching vehicle according to claim 15, comprising three modular rocket receiving housings, the three modular rocket receiving housings being able to be attached together to the rocket support portion.

17. Rocket launching vehicle according to claim 14, wherein each actuator is powered by an electric motor and is connected to the sliding table by a transition piece.

18. Rocket launching vehicle according to claim 12, further comprising at least one modular rocket receiving housing configured to be secured to the rocket support portion.

19. Rocket launching vehicle according to claim 18, wherein the pivotable body of the targeting device is designed such that the position and its pivot axis coincide with the center of mass of the support portion receiving the modular rocket receiving housings.

20. Rocket launching vehicle according to claim 19, wherein the pivoting movement of the turntable and the pivoting movement of the pivotable body are driven by an electric actuator.

* * * * *